United States Patent [19]

Schubert

[11] Patent Number: 4,776,199

[45] Date of Patent: Oct. 11, 1988

[54] WORKPIECE CLAMPING DEVICES IN FORGING MANIPULATORS

[75] Inventor: Peter Schubert, Kaarst, Fed. Rep. of Germany

[73] Assignee: SMS Hasenclever Maschinenfabrik GmbH, Dusseldorf, Fed. Rep. of Germany

[21] Appl. No.: 87,041

[22] Filed: Aug. 19, 1987

[30] Foreign Application Priority Data

Aug. 21, 1986 [DE] Fed. Rep. of Germany ..... 3628407

[51] Int. Cl.[4] ..... B21D 43/10

[52] U.S. Cl. ..... 72/422; 72/453.08; 294/88; 294/116; 279/4

[58] Field of Search ..... 72/420, 422, 453.02, 72/453.08; 294/88, 115, 116, 106; 414/622, 753; 279/4

[56] References Cited

U.S. PATENT DOCUMENTS 4,599,037 7/1986 Ross et al. ..... 414/753
4,624,050 11/1986 Hawkswell ..... 294/2

FOREIGN PATENT DOCUMENTS 880419 6/1953 Fed. Rep. of Germany ..... 72/422
144839 11/1981 Japan ..... 72/422
172622 8/1986 Japan ..... 72/422

*Primary Examiner*—Lowell A. Larson
*Attorney, Agent, or Firm*—Holman & Stern

[57] ABSTRACT

A forging manipulator has two pairs of workpiece gripping arms which operate in respective mutually perpendicular planes. Each pair of arms is operable by a respective independent actuating mechanism, so that the respective pairs of arms can accommodate workpiece dimensions. The two actuating mechanisms comprise:

a common bore in the gripper carrier of the manipulator, defining two co-axial fluid pressure cylinder disposed end to end, a respective annular piston in each of these cylinders, a respective hollow piston rod extending from each piston towards the gripper arms, one of these piston rods extending within the other piston rod, and a respective wedge at the forward end of each piston rod, for operating the corresponding pair of gripper arms on movement of the piston rod. The wedges slope in opposite directions, and the pistons move simultaneously in opposite directions. This provides a very compact construction and allows material and tools to be delivered to and removed from the manipulator from the rear through the hollow piston rods.

8 Claims, 3 Drawing Sheets

WORKPIECE CLAMPING DEVICES IN FORGING MANIPULATORS

BACKGROUND OF THE INVENTION

The clamping device for workpieces forged in forging manipulators are formed with two gripper arms, or four gripper arms which are pivotable in pairs in intersecting planes, in a bearing head, which arms at one of their ends support clamping jaws pivotable about axes parallel to the pivot axes of the respective gripper arms. At their other ends, displacement means, such as piston-cylinder units which act directly or by way of wedges, links or push rods, act upon the gripper arms by which means the closure of the grippers is effected. In general there are only two gripper arms, which are provided with clamping jaws with V-shaped grooves. The invention relates to clamping devices which are provided with four gripper arms and four clamping jaws.

The clamping devices provided with four gripper arms with clamping jaws generally comprise, like the clamping devices provided with only two gripper arms with clamping jaws, only a single displacement means, by which the gripper arms with their clamping jaws are moved uniformly and in the same direction. As a result these clamping devices are suitable only for clamping workpieces whose clamping areas are at the same distance, in the planes intersecting at right angles, from the axis of the workpiece in the clamping area, for example a circular or square cross-section. For clamping forged pieces with a non-round cross-section in the clamping area, for example a rectangular or oval cross-section, it is known (German Patent DE No. 24 11 112) to construct the gripper arms which can be moved in pairs independently of one another, each pair of grippers having associated with it its own displacement means comprising a piston with a head member connected by way of push rods to the gripper arms of the pair, and the displacement means pistons being a solid piston and an annular piston arranged coaxially in a common cylinder connected to the bearing head of the gripper arms and mounted rotatably in the frame supporting the clamping device.

The solid and annular pistons, provided for the independent separate movement of the gripper arms in pairs in accordance DE No. 24 11 112, do not permit the delivery of tools or of workpieces from the rear or their removal through the clamping device, as is desired, however, in particular in forging manipulators which cooperate with so-called forging machines, whose rams and tools arranged in an X-shaped are moved radially to the workpiece. In this connexion the space required for the two nested pistons is a disadvantage. The object of the invention is to overcome the aforesaid disadvantages by a support, space-saving design of the clamping device.

SUMMARY OF THE INVENTION

According to the invention the pistons are both annular pistons arranged in a cylinder bore of the gripper carrier axially one behind the other and movable in opposite directions, and the piston more remote from the bearing head passes with its piston rod through the piston closer to the bearing head and through the hollow piston rod associated with the latter piston and the associated head member acting upon the gripper arms of the associated pair of arms. This provides a very compact design. According to a preferred feature of the invention, the piston rod of the piston more remote from the bearing head is also made hollow; in addition to the compactness design this also makes it possible for material and tools, such as in particular mandrel rods when forging hollow pieces, to be delivered and removed through this hollow piston rod.

Clamping forces of equal magnitude at the clamping jaws of both pairs of grippers are achieved if, according to a further feature of the invention, the pistons have equal internal and external diameters of the effctive piston areas.

The compact, space-saving design of the clamping device, which is sought by the invention, is also attained in that according to a further feature of the invention the head members of the piston rods are constructed as wedges which force the gripper arms apart, the wedges of one and the other pair of gripper arms having operative surfaces which rise in opposite directions, the piston rod of the piston more remote from the bearing head acting as a pull rod and the other piston rod acting as a push rod.

Guidance, sufficient for the high stresses in the compact design, for the pistons arranged one behind the other in opposite directions, is made possible according to a further feature of the invention in that the bearing head is provided with a central bore in which the free end of the piston rod connected to the piston remote from the bearing head is guided axially movably, while the hollow piston rod connected to the piston disposed closer to the bearing head is guided axially movably.

BRIEF DESCRIPTION OF THE DRAWINGS

Preferred embodiments of the invention are shown in the drawings, in which.

DESCRIPTION OF PREFERRED EMBODIMENTS

Figure 1:
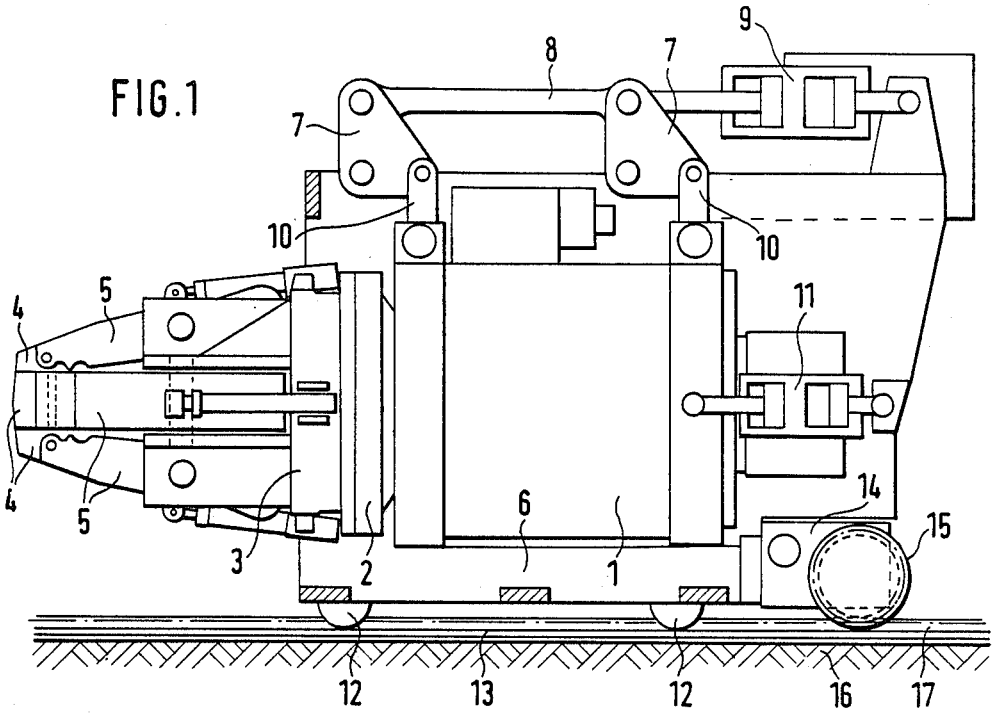
FIG. 1 and FIG. 2 are overall elevations of forging manipulators of different design with their clamping devices.

The illustrated forging manipulators are provided with a gripper carrier 2, which is rotatable in a gripper bearing 1, and comprises a bearing head 3 and gripper arms 5, pivotably mounted therein and provided with clamping jaws 4, together forming a clamping device, which in the case of the embodiment illustrated in FIG. 1 is suspended in the manipulator frame 6 by Crank levers 7 pivotably mounted in the manipulator frame 6. The Crank levers 7 used for the front and rear suspension are connected together by coupling links 8 and are held by double piston-cylinder units 9 so as to be displaceable on the one hand and resiliently yielding on the other. The angle levers 7 carry the gripper bearing 1 by way of pull rods 10, the gripper bearing 1 being supported so as to be axially displaceable in the horizontal direction by piston-cylinder units 11 and resiliently yielding. The manipulator frame 6 is provided with wheels 12 and can be driven on rails 13 by the travel drive 14, the pinion 15 of which engages in a toothed rack 17 secured by the rails 13 to the foundation 16.

Figure 2:
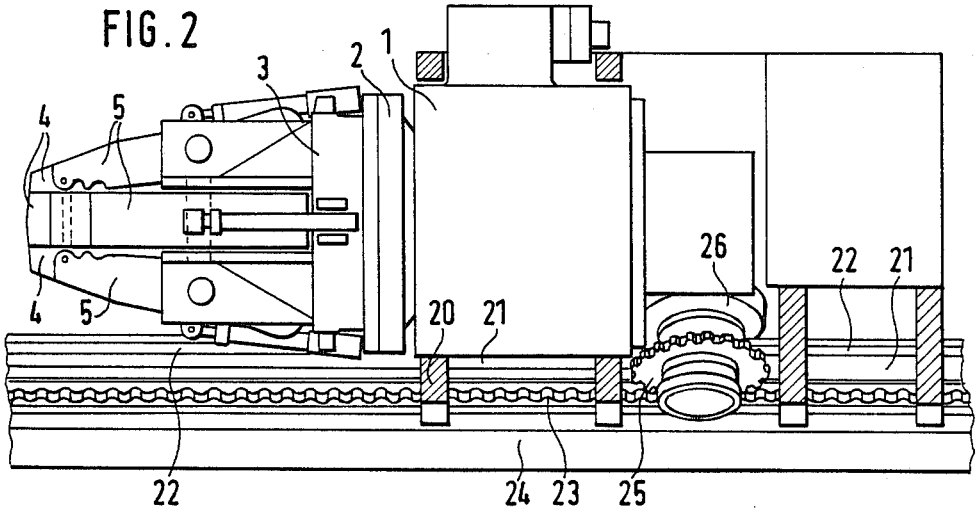

If the forging manipulator is associated with a forging machine with forging tools moved in opposite directions, a suspension which allows for vertical displacement of the clamping device is unnecessary. In the embodiment shown in side elevation in FIG. 2 and on a larger scale in end elevation in FIG. 4, the gripper bearing 1 of the clamping device is therefore securely joined to the manipulator frame 20, which is provided with tongues 21 and movable in slide guides 22. Toothed racks 23, in which pinions 25 of travel drives 26 mesh, are secured parallel to the slide guides 22 in the foundation frame 24.

Figure 3:
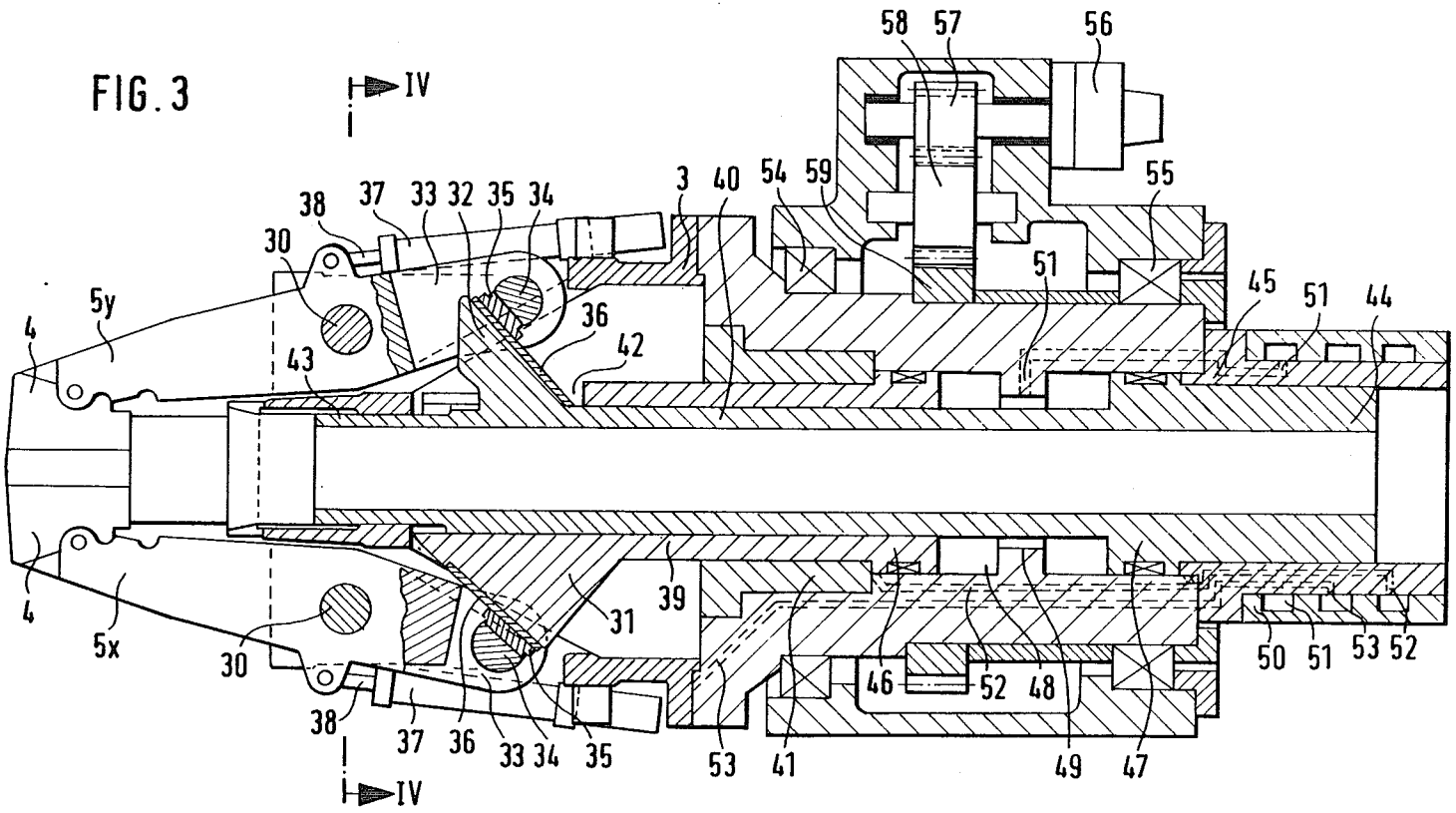
FIG. 3 is an axial section of the manipulator of FIG. 2, on an enlarged scale, along the line III—III indicated in FIG. 4.
Figure 4:
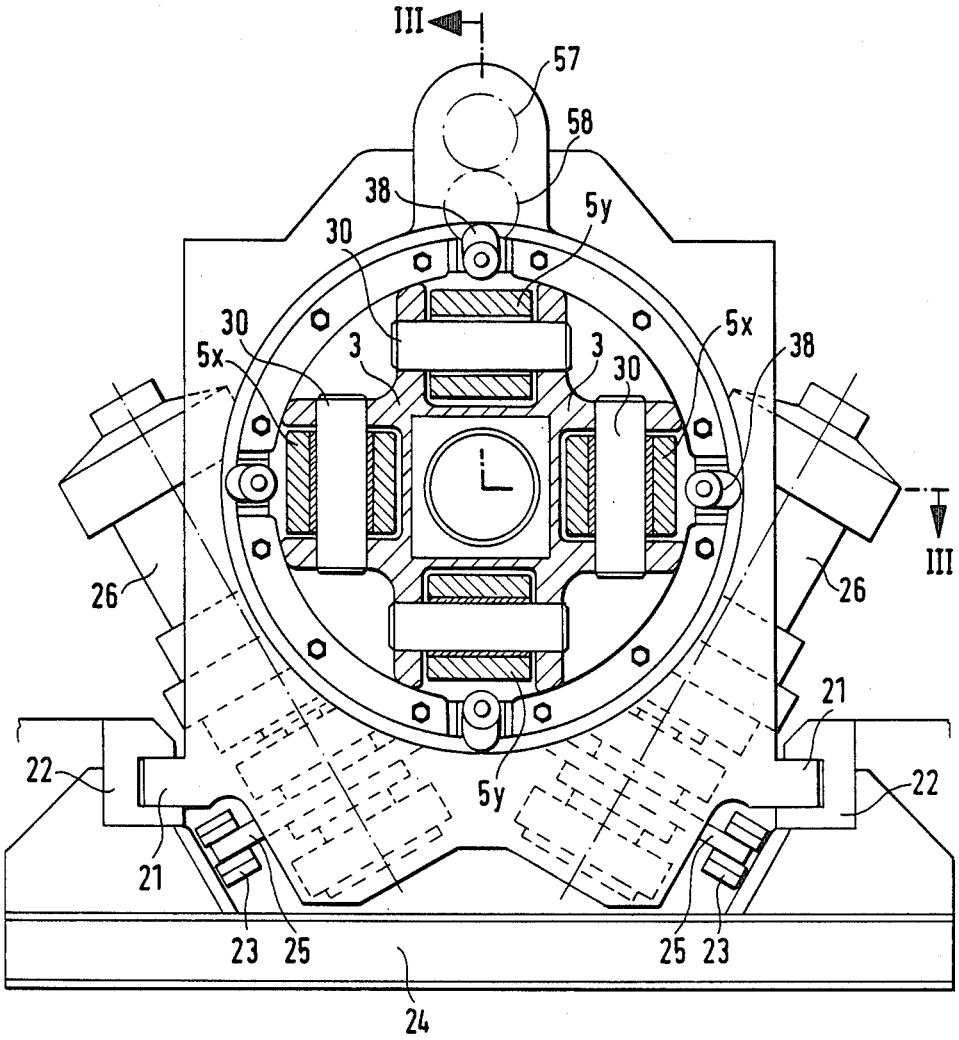
FIG. 4 is a section of the manipulator of FIG. 2, on the radial plane of IV—IV in FIG. 3.

The details of the clamping device are shown on an enlarged scale in FIGS. 3 and 4. Gripper arms 5 are provided for clamping a forged piece and are movable separately in pairs, so that the gripper arms 5*x* opposite one another in one plane, and the gripper arms 5*y* opposite one another crosswise in another plane, can adjust to workpiece dimensions which differ in these planes, for example for clamping a workpiece cross-section with dimensions differing in the x- and y-axes. For this purpose, as shown in the lower half of FIG. 3, the gripper arms 5*x*, pivotable in the bearing head 3 about pins 30, are movable by a double wedge 31, only half of which is shown, and as shown in the upper half of FIG. 3, the gripper arms 5*y* pivotable in the bearing head 3 about pins 30 are movable by a double wedge 32, only half of which is shown, and the double wedges 31 and 32 are movable separately individually. The gripper arms 5*x* and 5*y* are each provided at one of their ends with forks forming slots 33 which receive the wedges 31 and 32. Pins 34, which bear with part-cylindrical thrust members 35 on the operating surfaces of the double wedges 31 and 32 provided with wearing strips 36, are pivotably mounted in bores at the ends of the forks. Each of the gripper arms 5 has associated with it a hydraulic cylinder 37 which is articulated in the bearing head 3, and the cylinders 37 guide pistons 38 which are connected to the gripper arms 5 and act upon the latter so as to open them and hold them by way of the pins 34 and thrust members 35, in constant abutment on the operating surfaces of the double wedges 31 and 32.

The double wedge 31 associated with the gripper arms 5*x* is connected to a hollow cylindrical push rod 39, while the double wedge 32 associated with the gripper arms 5*y* is connected to a hollow cylindrical pull rod 40. The double wedges 31 form a head member for the push rod 39, while the double wedges 32 form a head member for the pull rod 40.

The push rod 39 is guided by a bush 41 which is inserted in the gripper carrier 2. The push rod 39 is provided with radial slots 42 for the passage of the double wedge 32. The pull rod 40 is guided in the bore of the hollow push rod 39, and is guided by its front extension 43 in a central bore in the bearing head 3 and by its rear extension 44 in a bush 45 in the gripper carrier 2. The push rod 39 is connected at its rear end, remote from the double wedge 31, to an annular piston 46, and the pull rod 40 is connected at its rear end remote from the double wedge 32 to an annular piston 47. The gripper carrier 2 connected to the bearing head 3 is drilled out with bores 48 to form the cylinder in which the pistons 46 and 47 are guided and can be pressurized. A collar 49 in the cylinder bore 48 is provided for limiting the strokes of the pistons 46 and 47. The bush 45 connected to the gripper carrier 2 and rotatable therewith is provided with a non-rotatable bush 50 which is mounted thereon and by way of which a pressure medium, in particular hydraulic fluid, is supplied to the lines 51, 52 and 53. The pressure medium can be applied to the pistons 46 and 47 by way of the line 51 so as to urge the pistons apart and thereby close the jaws and by way of the line 52 so as to urge the pistons together and thereby open the jaws; while the pistons 38 in the cylinders 37 can be pressurized by way of the line 53.

It will be ssen that the pistons have equal internal and external diameters of the effective piston areas.

The gripper carrier 2 is rotatable in the gripper bearing 1 in the bearings 54 and 55. The rotation is performed by a motor 56, by way of the pinion 57 mounted on the motor shaft, the intermediate wheel 58 and the toothed ring 59 connected to the gripper carrier 2.

I claim:

1. A forging manipulator which includes a gripper carrier and workpiece clamping means thereon comprising:

a first pair of gripper arms pivotable on the gripper carrier towards are another in a first plane, and a second pair of gripper arms pivotable on the gripper carrier towards one another in a second plane intersecting the first plane, each gripper arm having a forward end and a rear end; respective clamping jaws on said gripper arms at said forward ends thereof;

a first longitudinal annular cylinder in said gripper carrier;

a first annular piston slidable in said first cylinder;

a first piston rod connected to said first piston and extending longitudinally towards said gripper arms;

a first head means connected to said first piston rod for actuating said first pair of gripper arms for opening and closing said gripper arms on longitudinal sliding of said first piston rod;

a second longitudinal annular cylinder in said gripper carrier disposed between said first cylinder and said gripper arms;

a second annular piston slidable in said second cylinder;

a hollow second piston rod connected to said second piston and extending longitudinally towards said gripper arms;

second head means connected to said second piston rod for actuating said second pair of gripper arms for opening and closing said second gripper arms on longitudinal sliding of said second piston rod;

said first piston rod extending slidably within said second piston, second piston rod and second head means;

and means for pressurising said first and second cylinders for moving said first and second pistons simultaneously in respective opposite directions, for opening and closing said gripper arms.

2. A forging manipulator according to claim 1, in which the first piston rod has a longitudinal axial through bore providing access there through the region of said clamping jaws.

3. A forging manipulator which includes a gripper carrier and workpiece clamping means thereon comprising:

a first pair of gripper arms pivotable on the gripper carrier towards one another in a first plane, and a second pair of gripper arms pivotable on the gripper carrier towards one another in a second plane intersecting the first plane, each gripper arm having a forward end and a rear end;

respective clamping jaws on said gripper arms at said forward ends thereof;

a first longitudinal annular cylinder in said gripper carrier;

a first annular piston slidable in said first cylinder;

a first hollow piston rod connected to said first piston and extending longitudinally towards said gripper arms;

a first wedge means connected to said first piston rod for longitudinal sliding thereby and coupled to said first pair of gripper arms for opening and closing said first gripper arms on longitudinal sliding of said first wedge means; a second longitudinal annular cylinder in said gripper carrier between said first cylinder and said gripper arms;

a second annular piston slidable in said second cylinder;

a second hollow piston rod connected to said second piston and extending longitudinally towards said gripper arms, said first piston rod extending slidably through said second piston and second piston rod;

second wedge means connected to said second piston rod for longitudinal sliding thereby and coupled to said second pair of gripper arms for opening and closing said second gripper arms on longitudinal sliding of said second wedge means;

and means for pressuring said first and second cylinders for moving said first and second pistons simultaneously in respective opposite directions;

said first wedge means and second wedge means having respective angled operative surfaces for acting on said first and second gripper arms which surfaces of said first wedge means are angled oppositely to said surfaces of said second wedge means.

4. A clamping device for workpieces in a forging manipulator with four gripper arms which are pivotable in pairs in intersecting planes in a bearing head at one end of which arms clamping jaws pivotable about axes parallel to the pivot axis of the respective gripper arm are supported and the other end of which arms are engaged by displacement means which effect the gripper closure in pairs independently of one another and which comprise for each pair of arms one piston with a head member acting upon the gripper arms of one pair, the pistons of the displacement means being arranged coaxially in a common cylinder connected to the bearing head of the gripper arms and mounted rotatably in the frame supporting the clamping device, characterized in that the pistons are annular pistons arranged in the cylinder bore of the gripper carrier axially one behind the other and moving in opposite directions and the piston more remote from the bearing head with a piston rod of said piston passes through the piston closer to the bearing head and the hollow piston rod associated therewith and the head member thereof acting upon the gripper arms of the associated pair.

5. A clamping device according to claim 4, in which the piston rod of the piston move remote from the bearing head is hollow.

6. A clamping device according to claim 4 characterized in that the head members of the piston rods are wedges which spread the gripper arms, the respective wedges of the said pairs of gripper arms having operating surfaces which are inclined in opposite directions, and the piston rod of the piston more remote from the bearing head acting as a pull rod.

7. A clamping device according to claim 4 characterized in that the bearing head comprises a central bore in which the free end of the piston rod connected to the piston remote from the bearing head is guided axially movably, while the hollow piston rod connected to the piston positioned closer to the bearing head is guided movably by the aforesaid piston rod guided in the central bore of the bearing head.

8. A clamping device according to claim 1, characterized in that the pistons have equal internal and external diameters of their effective piston areas

* * * * *